US011473594B2

(12) United States Patent
Johnson et al.

(10) Patent No.: US 11,473,594 B2
(45) Date of Patent: Oct. 18, 2022

(54) COMPRESSOR

(71) Applicant: Dyson Technology Limited, Wiltshire (GB)

(72) Inventors: Mark Andrew Johnson, Bath (GB); Simon Alexander Locke, Swindon (GB); Matthew John Childe, Swindon (GB); Cathal Clancy, Swindon (GB); Vadivel Kumaran Sivashanmugam, Swindon (GB); Nora Er-Rouhly, Swindon (GB); Lukasz Andrzej Kowalczyk, Swindon (GB); Alan Glynn Sanderson, Old Basing (GB); Thomas Richard Stafford, Bath (GB); Sarah Elizabeth Elson, Swindon (GB); Alexander Thomas Wells, Gloucester (GB); Jim Ray Lluisma, Gloucester (GB)

(73) Assignee: Dyson Technology Limited, Malmesbury (GB)

( * ) Notice: Subject to any disclaimer, the term of this patent is extended or adjusted under 35 U.S.C. 154(b) by 48 days.

(21) Appl. No.: 17/056,361

(22) PCT Filed: Mar. 12, 2019

(86) PCT No.: PCT/GB2019/050680
§ 371 (c)(1),
(2) Date: Nov. 17, 2020

(87) PCT Pub. No.: WO2019/220071
PCT Pub. Date: Nov. 21, 2019

(65) Prior Publication Data

US 2021/0207617 A1 Jul. 8, 2021

(30) Foreign Application Priority Data

May 18, 2018 (GB) ..... 1808126

(51) Int. Cl.
*F04D 29/44* (2006.01)
*A47L 5/22* (2006.01)
*F04D 29/28* (2006.01)

(52) U.S. Cl.
CPC ..... *F04D 29/444* (2013.01); *A47L 5/22* (2013.01); *F04D 29/284* (2013.01); *F04D 29/441* (2013.01)

(58) Field of Classification Search
CPC .... F04D 29/444; F04D 29/284; F04D 29/441; F04D 25/0606; F04D 29/626;
(Continued)

(56) References Cited

U.S. PATENT DOCUMENTS 4,213,745 A 7/1980 Roberts
4,946,348 A 8/1990 Yapp
(Continued)

FOREIGN PATENT DOCUMENTS

CN 105626552 A 6/2016
EP 0349051 A1 1/1990
(Continued)

OTHER PUBLICATIONS

International Search Report and Written Opinion dated May 29, 2019, directed to International Application No. PCT/GB2019/050680; 10 pages.
(Continued)

*Primary Examiner* — Audrey B. Walter
*Assistant Examiner* — Edward Bushard
(74) *Attorney, Agent, or Firm* — Faegre Drinker Biddle & Reath LLP

(57) ABSTRACT

A compressor has a rotor assembly having an impeller for generating an airflow through the compressor, a stator core assembly for causing rotation of the impeller, and a diffuser assembly for acting on the airflow generated by the impeller.
(Continued)

The diffuser assembly has a first diffuser stage and a second diffuser stage. The first and second diffuser stages are separate components connected to one another by a fastener.

18 Claims, 16 Drawing Sheets

(58) Field of Classification Search
CPC ..... F04D 17/06; F04D 29/44; F04D 29/54; F04D 29/542; F04D 29/263; F04D 29/403; F04D 29/601; F04D 29/624; A47L 5/22; F05D 2250/51; F05D 2210/12
See application file for complete search history.

(56) References Cited

U.S. PATENT DOCUMENTS

| | | | | |
|---|---|---|---|---|
| 2003/0012646 | A1* | 1/2003 | Liao ..... | F04D 29/646 415/209.1 |
| 2017/0356673 | A1 | 12/2017 | Gauss | |

FOREIGN PATENT DOCUMENTS

| | | | | |
|---|---|---|---|---|
| EP | 2677174 | A2 | | 12/2013 |
| EP | 1544472 | B1 | | 1/2014 |
| EP | 3343042 | A1 | | 7/2018 |
| GB | 695948 | A | | 8/1953 |
| JP | 3724413 | B2 | | 12/2005 |
| JP | 2010-281231 | A | | 12/2010 |
| JP | 2010281231 | A | * | 12/2010 |
| WO | 02/082955 | A1 | | 10/2002 |
| WO | 2011/027519 | A1 | | 3/2011 |
| WO | 2013/053920 | A1 | | 4/2013 |

OTHER PUBLICATIONS

Search Report dated Oct. 18, 2018, directed to GB Application No. 1808126.5; 2 pages.

* cited by examiner

| | Parameters | First Diffuser Stage | Second Diffuser Stage | Third Diffuser Stage |
|---|---|---|---|---|
| Hub Geometry | Stagger Angle (°) | 57.4 | 39.8 | 19 |
| | Blade Inlet Angle (°) | 64.3 | 48.5 | 24.9 |
| | Blade Outlet Angle (°) | 26.2 | 25.2 | -5.9 |
| Mid-Point Geometry | Stagger Angle (°) | 54.0 | 33.4 | 21.4 |
| | Blade Inlet Angle (°) | 64.3 | 48.5 | 27.2 |
| | Blade Outlet Angle (°) | 26.5 | 18.6 | 0.4 |
| Outer Wall Geometry | Stagger Angle (°) | 53.7 | 34.3 | 19.7 |
| | Blade Inlet Angle (°) | 64.2 | 47.4 | 26.6 |
| | Blade Outlet Angle (°) | 26.2 | 20.9 | -5.3 |
| | Number of Blades | 11 | 19 | 25-33 |
| | Max Blade Thickness (m) | 0.0012 | 0.00063 | 0.00035 |
| | Location of Max Blade Thickness as Chord % | 41.74 | 34.14 | 39.00 |

FIG. 8

| | Parameters | First Diffuser Stage | Second Diffuser Stage | Third Diffuser Stage |
|---|---|---|---|---|
| Hub Geometry | Chord (m) | 0.0128 | 0.0091 | 0.0037 |
| | Axial Chord (m) | 0.007455 | 0.00698 | 0.0035 |
| | Solidity | 1.3 | 1.6 | 1.1 |
| | Axial Solidity | 0.76 | 1.2 | 1.1 |
| Mid-Point Geometry | Chord (m) | 0.01270 | 0.0084 | 0.0038 |
| | Axial Chord (m) | 0.007461 | 0.00698 | 0.0035 |
| | Solidity | 1.2 | 1.3 | 1.0 |
| | Axial Solidity | 0.6922 | 1.1 | 0.97 |
| Outer Wall Geometry | Chord (m) | 0.01261 | 0.0085 | 0.0037 |
| | Axial Chord (m) | 0.007466 | 0.00698 | 0.0035 |
| | Solidity | 1.08 | 1.2 | 0.9 |
| | Axial Solidity | 0.64 | 1.0 | 0.88 |
| Full Blade Geometry | Leading Edge Sweep (°) | -7 | 0 | 0 |
| | Trailing Edge Sweep (°) | 0 | 0 | 0 |
| | Lean at Hub (°) | -8 | 1.8 | -0.2 |
| | Lean at Outer Wall (°) | 8 | 0.1 | 0.5 |

FIG. 9

| | Parameters | First Diffuser Stage | Second Diffuser Stage | Third Diffuser Stage |
|---|---|---|---|---|
| Hub Geometry | Stagger Angle (°) | 60.2 | 33.0 | 17.0 |
| | Blade Inlet Angle (°) | 70.8 | 54.9 | 24.6 |
| | Blade Outlet Angle (°) | 46.7 | 14.4 | 6.5 |
| | Maximum Blade Thickness (m) | 0.000876 | 0.000642 | 0.000642 |
| | Location of Max Blade Thickness as % Chord | 35.0 | 37.6 | 37.6 |
| Outer Wall Geometry | Stagger Angle (°) | 58.2 | 27.2 | 17.0 |
| | Blade Inlet Angle (°) | 72.6 | 49.9 | 24.3 |
| | Blade Outlet Angle (°) | 39.3 | 8.4 | 6.8 |
| | Maximum Blade Thickness (m) | 0.000875 | 0.000640 | 0.000638 |
| | Location of Max Blade Thickness as % Chord | 33.7 | 36.6 | 26.3 |
| | Number of Blades | 11 | 23 | 23 |

FIG. 18

| | Parameters | First Diffuser Stage | Second Diffuser Stage | Third Diffuser Stage |
|---|---|---|---|---|
| Hub Geometry | Chord (m) | 0.0196 | 0.0083 | 0.0063 |
| | Axial Chord (m) | 0.0097 | 0.0070 | 0.0060 |
| | Solidity | 1.8 | 1.6 | 1.2 |
| | Axial Solidity | 0.9 | 1.4 | 1.2 |
| | Lean Beta | 1.6 | -0.1 | -0.1 |
| Outer Wall Geometry | Chord (m) | 0.0171 | 0.0078 | 0.0063 |
| | Axial Chord (m) | 0.0090 | 0.0070 | 0.0060 |
| | Solidity | 1.3 | 1.3 | 1.0 |
| | Axial Solidity | 0.7 | 1.1 | 1.0 |
| | Lean Beta | 1.6 | -0.1 | -0.1 |
| Full Blade | Sweep Beta | 25 | 0 | 0 |

FIG. 19

COMPRESSOR

CROSS REFERENCE TO RELATED APPLICATIONS

This application is a national stage application under 35 USC 371 of International Application No. PCT/GB2019/050680, filed on Mar. 12, 2019, which claims the priority of United Kingdom Application No. 1808126.5, filed May 18, 2018, the entire contents of each of which are incorporated herein by reference.

FIELD OF THE DISCLOSURE

The present invention relates to a compressor, and more particularly, although not exclusively, to a compressor for a vacuum cleaner.

BACKGROUND OF THE DISCLOSURE

Vacuum cleaners typically comprise compressors for generating a suction force to enable dirt and debris to be removed from a surface to be cleaned.

There is a general desire to improve compressors in a number of ways, including, for example, size, weight, manufacturing cost, efficiency, reliability, and noise. Improvements to compressors can lead to corresponding improvements for vacuum cleaners, including, for example, increased power and performance.

SUMMARY OF THE DISCLOSURE

According to a first aspect of the present invention there is provided a compressor comprising a rotor assembly having an impeller for generating an airflow through the compressor, a stator core assembly for causing rotation of the impeller, and a diffuser assembly for acting on the airflow generated by the impeller, wherein the diffuser assembly comprises a first diffuser stage and a second diffuser stage, the first and second diffuser stages comprising separate components connected to one another by a fastener.

The compressor according to the first aspect of the present invention may be advantageous principally as the diffuser assembly comprises a first diffuser stage and a second diffuser stage, the first and second diffuser stages comprising separate components connected to one another by a fastener. In particular, forming the first and second diffuser stages as separate components may enable the first and second diffuser stages to comprise more complex geometry than would otherwise be possible if the first and second diffuser stages were formed as a single component. For example, forming the first and second diffuser stages as separate components may enable each diffuser stage to comprise more complex diffuser blade geometries and/or diffuser blade spacing than would otherwise be possible if the first and second diffuser stages were formed as a single component. This may allow for enhanced performance of the compressor, and may, for example, provide improved pressure recovery downstream of the impeller. Having freedom of design over blade geometries may also enable the blade geometries to be designed to provide improved acoustic characteristics, for example.

The first and second diffuser stages may be formed by separate moulding processes, for example by separate injection moulding processes. The first and second diffuser stages may comprise a plastic material. This may ensure that the diffuser stages, and hence the compressor, remain as lightweight as possible. The first and second diffuser stages may comprise axial diffuser stages, for example diffuser stages intended to turn air toward an axial direction. The diffuser assembly may act on airflow generated by the impeller to turn air toward a substantially axial direction, for example a direction substantially parallel to an axis of rotation of the impeller.

The first diffuser stage may comprise a first hub, a first outer wall, and a first plurality of diffuser blades extending between the first hub and the first outer wall, and the second diffuser stage may comprise a second hub, a second outer wall, and a second plurality of diffuser blades extending between the second hub and the second outer wall. The first and second hubs and the first and second outer walls may define a common flow path, with the first and second pluralities of diffuser blades defining a plurality of flow passageways within the common flow path.

The plurality of flow passageways may be divergent along at least part of the length of the first and/or second diffuser stages. For example, the cross-sectional area of flow passageways of the first and/or second diffuser stage may increase along at least part of the length of the first and/or second diffuser stages. This may be beneficial as it may allow for improved pressure recovery and/or may allow for a reduction in speed of airflow through the first and/or second diffuser stages in use. The hub may diverge from the outer wall, or vice versa, or both the hub and the outer wall may diverge from one another.

The plurality of flow passageways of the first and/or second diffuser stages may comprise a stepped form. The first and/or second hubs may comprise a step into and/or out of the corresponding flow passageways. The first and/or second outer walls may comprise a step into and/or out of the corresponding flow passageways. This may be beneficial as airflow separation tends to occur at the boundaries of the flow passageways, for example at the hub or the outer wall, and by introducing a step into and/or out of the flow passageways separated airflow may be encouraged to re-join the main path of airflow through the flow passageways.

Where the first and/or second hub comprises a step into the corresponding flow passageway, the first and/or second outer wall may comprise a corresponding step out of the corresponding flow passageway, and vice versa. Thus the cross-sectional area of the flow passageways may be maintained along their length. This may be beneficial as it may maintain a desired level of pressure recovery in use, and may, for example, result in reduced air flow speed and better acoustics relative to a flow passageway having a cross-sectional area which reduces along its length.

A step into a hub may comprise a reduction in diameter of the hub and/or a step out of a hub may comprise an increase in diameter of the hub. A step into an outer wall may comprise a decrease in thickness of the outer wall, for example without any change to the overall diameter of the outer wall, and/or a step out of an outer wall may comprise an increase in thickness of the outer wall, for example without any change to the overall diameter of the outer wall.

The first and second hubs and the first and second outer walls may comprise a substantially cylindrical global form. This may be beneficial as a substantially cylindrical global form may take up less space than, for example, a cuboidal global form. The common flow path may be substantially annular in form, for example extending about the first and/or second hub, between the first and/or second hub and the first and/or second outer wall.

The first hub may comprise an outer diameter corresponding substantially to an outer diameter of the impeller. This may be beneficial as it may promote a smooth transition of air from the impeller to the common flow path, in use.

The fastener may extend between the first and second hubs, for example at a location remote from an outer diameter of the first and second hubs. This may be beneficial as it may ensure that the fastener is removed from the common flow path, and may prevent the fastener from interfering with airflow through the common flow path in use. This may also ensure that the first and second diffuser stages have as small a footprint as possible, as no additional components, for example extending radially outwardly from the outer walls, are necessary to connect the first and second diffuser stages.

The fastener may comprise a mechanical fastener, for example a screw or a bolt or the like. The use of a mechanical fastener may be beneficial over, for example, use of an adhesive, as with the use of adhesive there is a risk that adhesive may find its way into the common flow path during manufacture.

The compressor may comprise a plurality of fasteners, for example extending between the first and second hubs at a plurality of locations. This may be beneficial as it may inhibit separation of the first and second diffuser stages to a greater extent than a single fastener.

The first diffuser stage may comprise a recess and/or projection for receiving a corresponding projection and/or recess of the second diffuser stage. The first and/or second hub may be substantially hollow, and the second and/or first diffuser stage, for example the second and/or first hub, may comprise a locating projection which extends into the hollow interior of the first and/or second hub. This may be beneficial as the locating projection may increase the contact surface area between the first and second diffuser stages, and may, for example, act to more evenly distribute any forces which are applied to the first and/or second diffuser stage in use. For example, where a bending force is applied to the first and/or second diffuser stage about an axis substantially orthogonal to a longitudinal axis of the compressor, the locating projection may contact the interior of the hub to better distribute the applied force and resist separation of the first and/or second diffuser stage. This may also be beneficial as the combination of recess and projection may define a labyrinth seal at the interface between the first and second diffuser stages, thereby preventing airflow from leaking at the interface between the first and second diffuser stages in use.

The locating projection may extend about substantially the entire circumference of the second and/or first hub. This may be beneficial as it may maximise the contact surface area between the first and second diffuser stages, and may, for example, act to more evenly distribute any forces which are applied to the first and/or second diffuser stage in use. This may also be beneficial as a labyrinth seal may be defined about substantially the entire interface between the first and second diffuser stages.

Surfaces of the first and/or second hub and the first and/or second outer walls at the interface between the first and second diffuser stages may comprise chamfered or rounded edges. This may be beneficial as it may remove sharp edges from the common flow path, and hence inhibit turbulent airflow and/or flow separation within the common flow path.

The second diffuser stage may comprise an outer diameter smaller than an outer diameter of the first diffuser stage. This may be beneficial as it may ensure that the second diffuser stage does not extend radially outwardly of the first diffuser stage even when tolerances, for example tolerance stacks which occur due to the combination of separate components, are taken into account, and hence may ensure that the radial dimensions of the compressor are not increased by provision of the second diffuser stage.

The first diffuser stage may comprise a first anti-rotation projection and/or recess for engaging a corresponding second anti-rotation recess and/or projection of the second diffuser stage. This may be beneficial as it may prevent relative rotation between the first and second diffuser stages in use. The anti-rotation projections and/or recesses may be formed on a corresponding hub of the first and/or second diffuser stage.

The second diffuser stage may be located downstream of the first diffuser stage. The compressor may comprise a third diffuser stage located downstream of the second diffuser stage, and may, for example, comprise any desired number of diffuser stages with additional diffuser stages being located sequentially downstream of the previous diffuser stage. The separate nature of the diffuser stages may in effect provide a modular diffuser system, enabling a large variety of combinations of diffuser stages to achieve desired flow results.

The third diffuser stage may comprise similar features to the second diffuser stage, for example with regard to attachment features which allow the diffuser stages to be connected to one another. The second diffuser stage may comprise a recess, for example a hollow second hub, which receives a locating projection of the third diffuser stage, or vice versa. The third diffuser stage may be connected to the first and second diffuser stages by the same fastener which connects the first and second diffuser stages. For example, the fastener may extend between the first and third diffuser stages.

Diffuser stages of the compressor may be referred to hereafter as upstream or downstream diffuser stages relative to an adjacent diffuser stage, or relative to the arrangement of diffuser stages as a whole.

A downstream diffuser stage may comprise a greater number of diffuser blades than an upstream diffuser stage. For example, the second diffuser stage may comprise a greater number of diffuser blades than the first diffuser stage and/or the third diffuser stage may comprise a greater number of diffuser blades than the second diffuser stage. In a presently preferred embodiment the first diffuser stage may comprise 11 diffuser blades, the second diffuser stage may comprise 19 diffuser blades, and the third diffuser stage may comprise in the region of 25-33 diffuser blades. In another presently preferred embodiment the first diffuser stage may comprise 11 diffuser blades, the second diffuser stage may comprise 23 diffuser blades, and the third diffuser stage may comprise 23 diffuser blades.

Blade inlet angles may vary between diffuser stages. A downstream diffuser stage may comprise a smaller blade inlet angle than an upstream diffuser stage. For example, the second diffuser stage may comprise a smaller blade inlet angle than the first diffuser stage and/or the third diffuser stage may comprise a smaller blade inlet angle than the second diffuser stage. This may be beneficial as the diffuser stages may gradually turn air flow from a radial direction at the outlet of the impeller to an axial direction at an exit of the diffuser stages. The blade inlet angle may comprise an angle between a line parallel to a central longitudinal axis of the compressor and a line tangential to a camber curve of a diffuser blade at the leading edge of the diffuser blade.

Blade outlet angles may vary between diffuser stages. A downstream diffuser stage may comprise a smaller blade outlet angle than an upstream diffuser stage. For example, the second diffuser stage may comprise a smaller blade outlet angle than the first diffuser stage and/or the third diffuser stage may comprise a smaller blade outlet angle than the second diffuser stage. This may be beneficial as the diffuser stages may gradually turn air flow from a radial direction at the outlet of the impeller to an axial direction at an exit of the diffuser stages. The blade outlet angle may comprise an angle between a line parallel to a central longitudinal axis of the compressor and a line tangential to a camber curve of a diffuser blade at the trailing edge of the diffuser blade.

An upstream diffuser stage may comprise a blade outlet angle which is smaller than a blade inlet angle of an adjacent downstream diffuser stage. For example, the first diffuser stage may comprise a blade outlet angle which is smaller than a blade inlet angle of the second diffuser stage and/or the second diffuser stage may comprise a blade outlet angle which is smaller than a blade inlet angle of the third diffuser stage. This may be beneficial as flow tends to separate from a blade prior to reaching the trailing edge. Thus by making the blade outlet angle of an upstream diffuser stage smaller than a blade inlet angle of the adjacent downstream diffuser stage, air leaving the upstream diffuser stage may be at an angle which more closely matches the blade inlet angle of the downstream diffuser stage than, for example, a situation where the blade outlet angle of the upstream diffuser stage is greater than or equal to the blade inlet angle of the adjacent downstream diffuser stage. This may prevent flow separation as airflow transitions from the first diffuser stage to the second diffuser stage in use.

A downstream-most diffuser stage may comprise a negative blade outlet angle. For example, the third diffuser stage may comprise a negative blade outlet angle. This may be beneficial as flow tends to separate from a blade prior to reaching the trailing edge. Thus by making the downstream-most diffuser stage comprise a negative blade outlet angle, air leaving the downstream-most diffuser stage may be flowing in a direction substantially parallel to a central longitudinal axis of the compressor, for example in a substantially axial direction, as the blade may lie in a direction parallel to a central longitudinal axis of the compressor prior to the trailing edge. A negative blade outlet angle may correspond to a line tangential to a camber curve at the trailing edge being inclined in a direction opposite to the direction of inclination of a line tangential to the camber curve at the leading edge.

The first diffuser stage may comprise a blade inlet angle in the range of 60-75°. The first diffuser stage may comprise a blade inlet angle in the range of 63-75°. The first diffuser stage may comprise a blade inlet angle in the range of 64-73°. The first diffuser stage may comprise a blade outlet angle in the range of 20-50°. The first diffuser stage may comprise a blade outlet angle in the range of 25-47°.

The second diffuser stage may comprise a blade inlet angle in the range of 40-60°. The second diffuser stage may comprise a blade inlet angle in the range of 46-56°. The second diffuser stage may comprise a blade outlet angle in the range of 5-30°. The second diffuser stage may comprise a blade outlet angle in the range of 8-26°.

The third diffuser stage may comprise a blade inlet angle in the range of 20-30°. The third diffuser stage may comprise a blade inlet angle in the range of 24-28°. The third diffuser stage may comprise a blade outlet angle in the range of −10 to 10°. The third diffuser stage may comprise a blade outlet angle in the range of −7 to 7°.

Stagger angle may vary between diffuser stages. A downstream diffuser stage may comprise a stagger angle which is smaller than a stagger angle of an upstream stage. For example, the second diffuser stage may comprise a stagger angle smaller than a stagger angle of the first diffuser stage and/or the third diffuser stage may comprise a stagger angle smaller than a stagger angle of the second diffuser stage. This may be beneficial as the diffuser stages may gradually turn air flow from a radial direction at the outlet of the impeller to an axial direction at an exit of the diffuser stages. The stagger angle may comprise an angle between a line parallel to a central longitudinal axis of the compressor and a line extending between a leading edge and a trailing edge of a diffuser blade, for example an angle between a line parallel to a central longitudinal axis of the compressor and a chord of the diffuser blade.

The first diffuser stage may comprise a stagger angle of between 50-65°. The first diffuser stage may comprise a stagger angle in the range of 52-63°. The second diffuser stage may comprise a stagger angle in the range of 25-45°. The second diffuser stage may comprise a stagger angle in the range of 27-40°. The third diffuser stage may comprise a stagger angle in the range of 15-25°. The third diffuser stage may comprise a stagger angle in the range of 17-23°.

Maximum blade thickness may vary between diffuser stages. A downstream diffuser stage may comprise a maximum blade thickness smaller than a maximum blade thickness of an upstream diffuser stage. For example, the second diffuser stage may comprise a smaller maximum blade thickness than the first diffuser stage and/or the third diffuser stage may comprise a smaller maximum blade thickness than the second diffuser stage.

Blade chord length may vary between diffuser stages. For example, the second diffuser stage may comprise a chord length smaller than a chord length of the first diffuser stage and/or the third diffuser stage may comprise a chord length smaller than a chord length of the second diffuser stage.

Blade solidity may vary between diffuser stages. For example, the second diffuser stage may comprise a greater blade solidity than the first diffuser stage and/or the third diffuser stage may comprise a lower blade solidity than the second diffuser stage.

Properties of individual blades of a diffuser stage may vary in a radial direction. For example, each individual blade of a diffuser stage may comprise a cross-sectional shape which varies in a radial direction. Any or any combination of the following properties of a blade may vary in a radial direction: stagger angle; blade inlet angle; blade outlet angle; blade thickness; chord length; solidity; leading edge sweep; trailing edge sweep; lean at hub; and lean at shroud.

Blades of the second and/or third diffuser stages may extend along substantially the entire axial extent of the second and/or third diffuser stages, for example along substantially the entirety of the diffuser stage in a direction parallel to a central longitudinal axis of the compressor. This may be beneficial as it may increase the length over which airflow is guided.

The impeller may comprise a mixed flow impeller, for example an impeller which outputs air having both axial and radial components.

The diffuser assembly may comprise an axial diffuser assembly, for example a diffuser assembly intended to turn airflow from a substantially radial direction to a substantially axial direction.

Diffuser stages of the present invention may comprise a modular nature, which may, for example, enable different configurations of diffuser stages to be assembled according to desired operating characteristics of the compressor.

The compressor may comprise a compressor for a vacuum cleaner.

According to a further aspect of the present invention there is provided a vacuum cleaner comprising a compressor according to the first aspect of the present invention.

According to a further aspect of the present invention there is provided a diffuser assembly for a compressor, the diffuser assembly comprising a first diffuser stage and a second diffuser stage, wherein the first and second diffuser stages comprise separate components connected to one another by a fastener.

Preferential features of aspects of the present invention may be equally applied to other aspects of the present invention, where appropriate.

BRIEF DESCRIPTION OF THE FIGURES

In order to better understand the present invention, and to show more clearly how the invention may be put into effect, the invention will now be described, by way of example, with reference to the following drawings:

FIG. 8 is a first table indicating parameters of blades of the diffuser stages of FIGS. 5A-B through 7A-B;

FIG. 9 is a second table indicating parameters of blades of the diffuser stages of FIGS. 5A-B through 7A-B;

FIG. 18 is a first table indicating parameters of blades of the diffuser stages of FIG. 17; and FIG. 19 is a second table indicating parameters of blades of the diffuser stages of FIG. 17.

DETAILED DESCRIPTION OF THE DISCLOSURE

Figure 1:
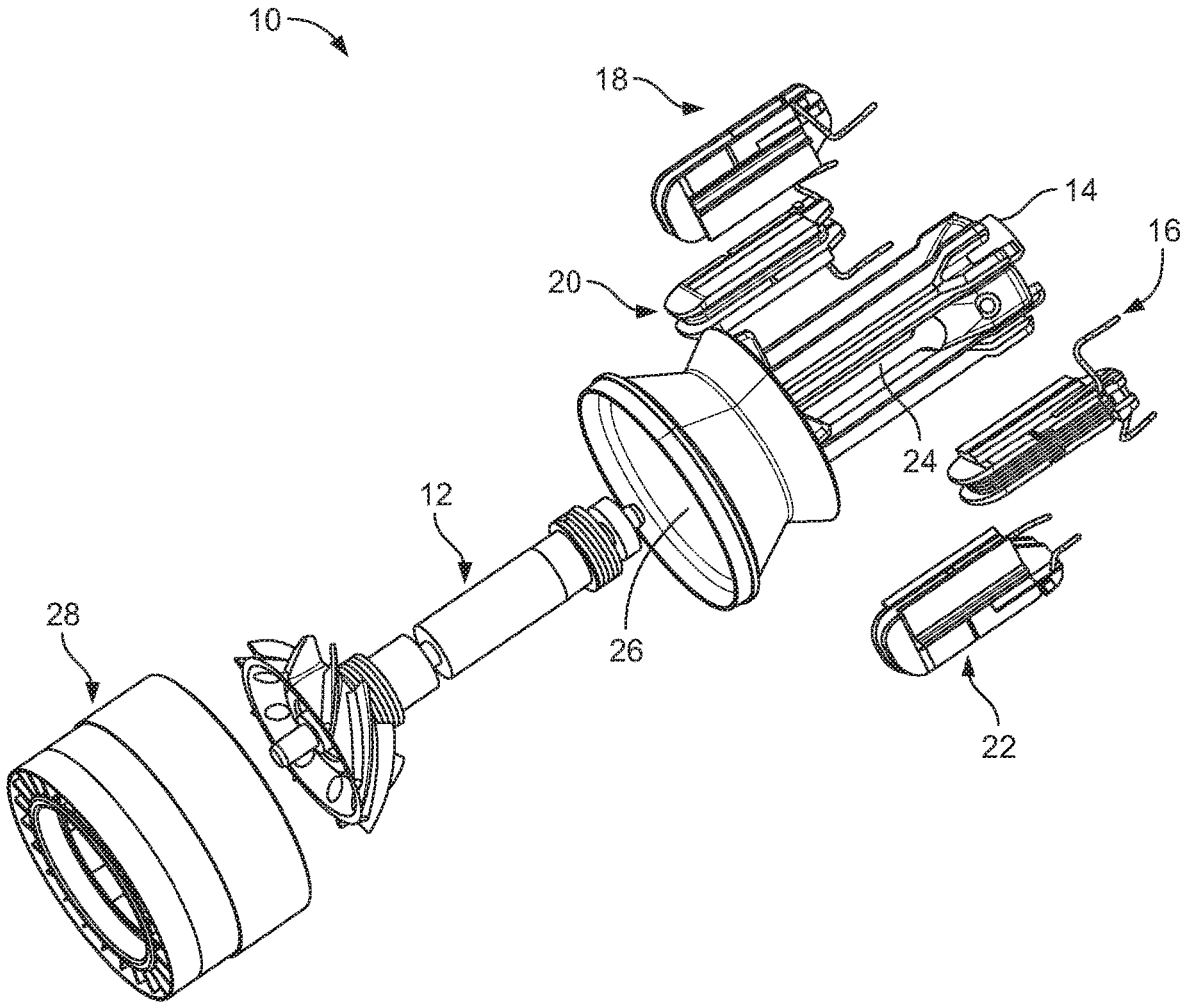
FIG. 1 is an exploded perspective view of a compressor according to aspects of the present invention.
Figure 4:
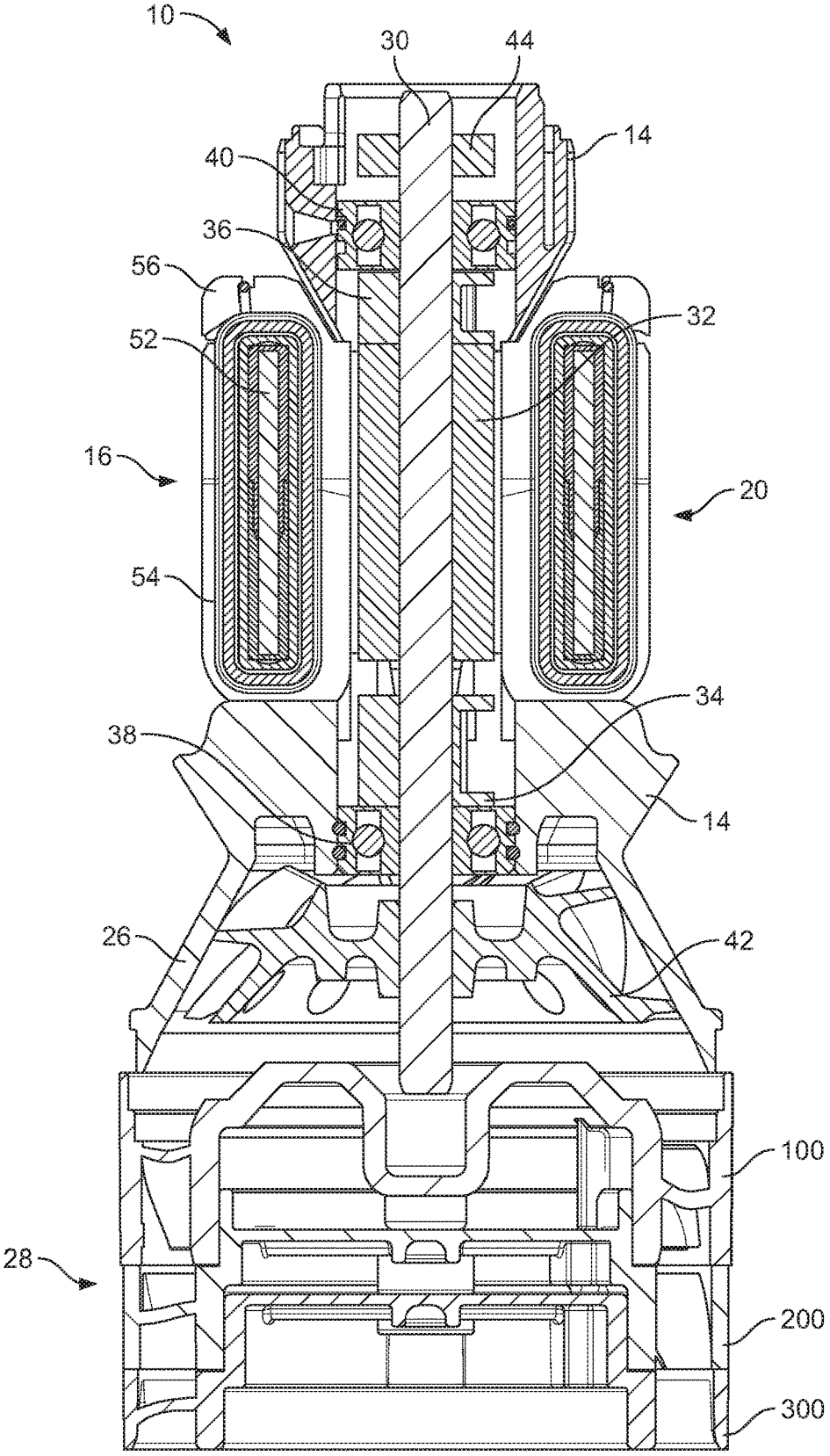
FIG. 4 is a cross-sectional view of the compressor of FIG. 1 taken along a central longitudinal axis of the compressor of FIG. 1.
Figure 5A:
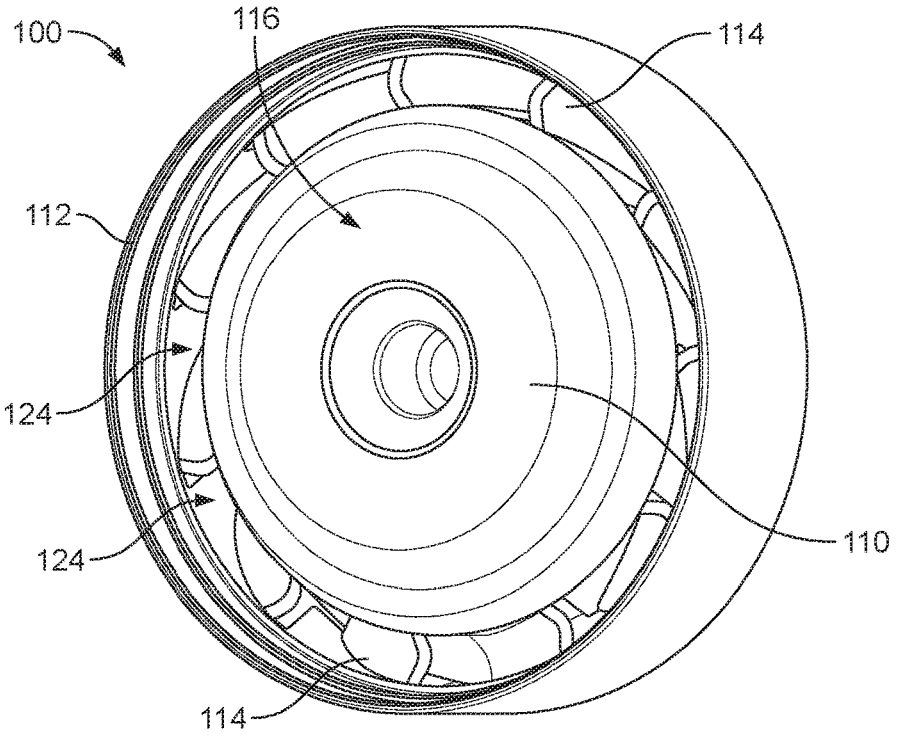
FIG. 5A is a front perspective view of a first diffuser stage of a diffuser assembly of the compressor of FIG. 1.
Figure 5B:
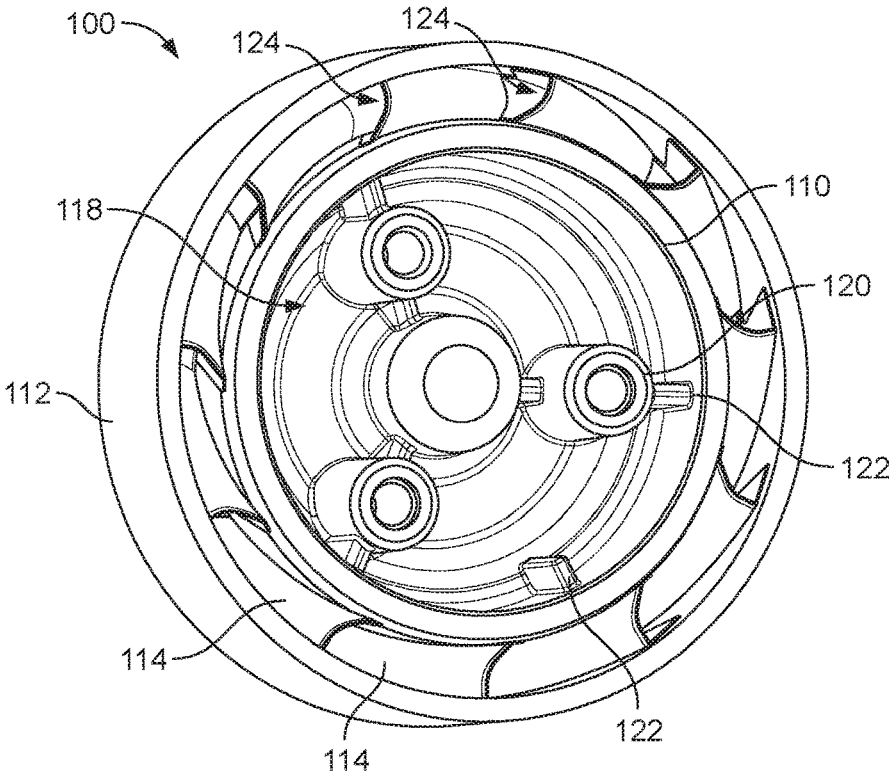
FIG. 5B is a rear perspective view of a first diffuser stage of a diffuser assembly of the compressor of FIG. 1.
Figure 6A:
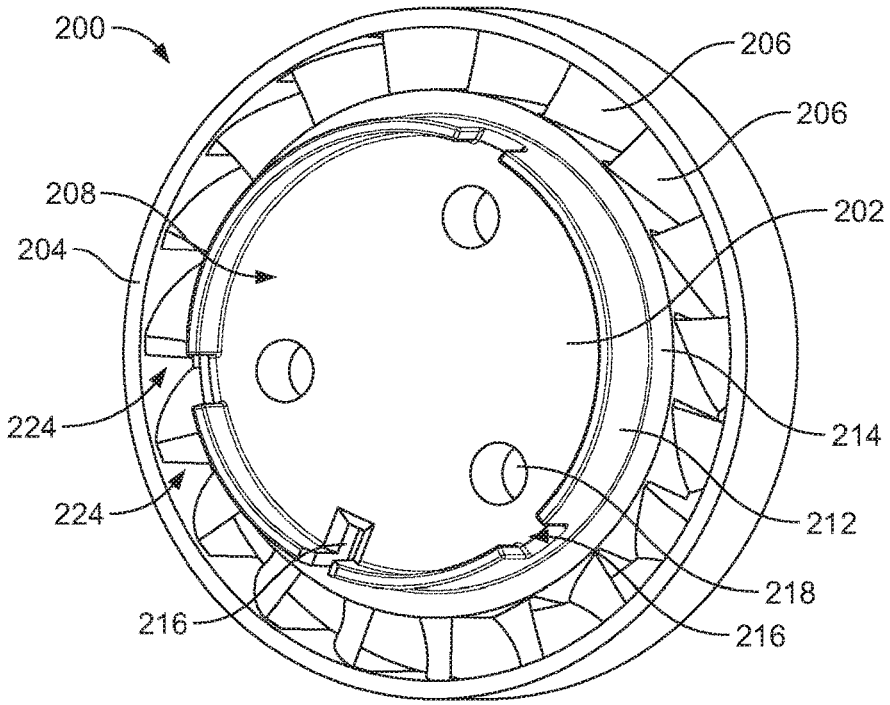
FIG. 6A is a front perspective view of a second diffuser stage of a diffuser assembly of the compressor of FIG. 1.
Figure 6B:
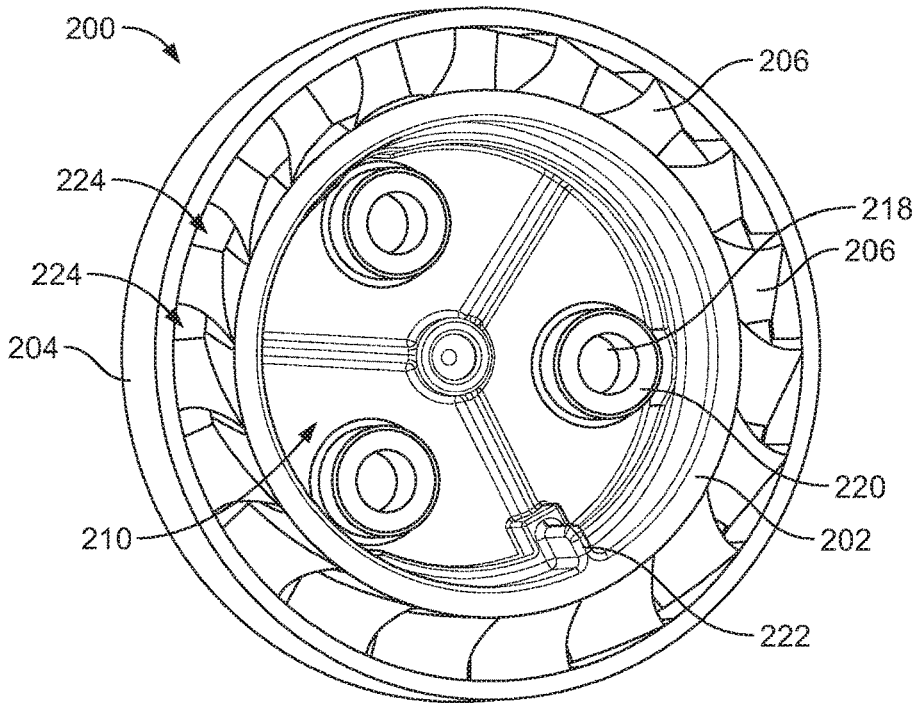
FIG. 6B is a rear perspective view of a second diffuser stage of a diffuser assembly of the compressor of FIG. 1.

FIG. 1 shows an exploded perspective view of a compressor 10 according to an embodiment of the present invention. Certain components, such as control electronics and an external housing, are not shown for clarity. The compressor 10 includes a rotor assembly 12, a frame 14 and four stator core assemblies 16, 18, 20 and 22. When the compressor 10 is assembled, the rotor assembly 12 is located within and mounted to the frame 14, and the stator core assemblies 16, 18, 20, 22 are located in respective slots in the frame 14. For example, the stator core assembly 16 is located within slot 24 in the frame 14. The frame 14 may be a one-piece construction, for example moulded as a single object, and includes an impeller shroud 26 that covers the impeller 42 as shown in FIG. 4. The compressor 10 also includes a diffuser assembly 28.

Figure 2:
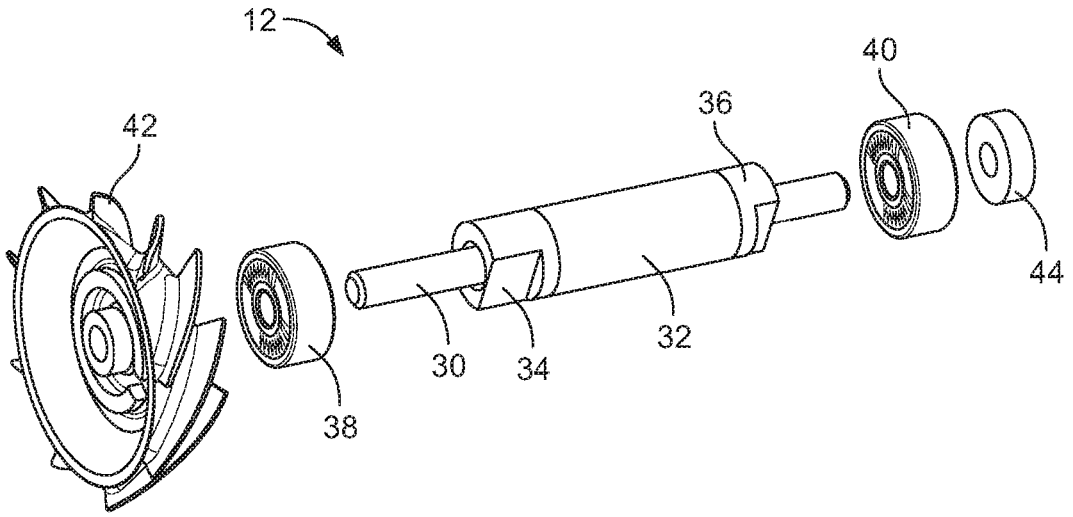
FIG. 2 is an exploded perspective view of a rotor assembly of the compressor of FIG. 1.

FIG. 2 shows an exploded perspective view of the rotor assembly 12. The rotor assembly 12 comprises a shaft 30 on which is mounted a rotor core permanent magnet 32, a first balancing ring 34 and a second balancing ring 36. When the rotor assembly 12 is assembled, a pair of bearings 38, 40 are mounted on the shaft 30 on either side of the core 32 and balancing rings 34, 36. An impeller 42 is mounted at one end of the shaft 30, and a sensor magnet 44 is mounted at the other end.

Figure 3:
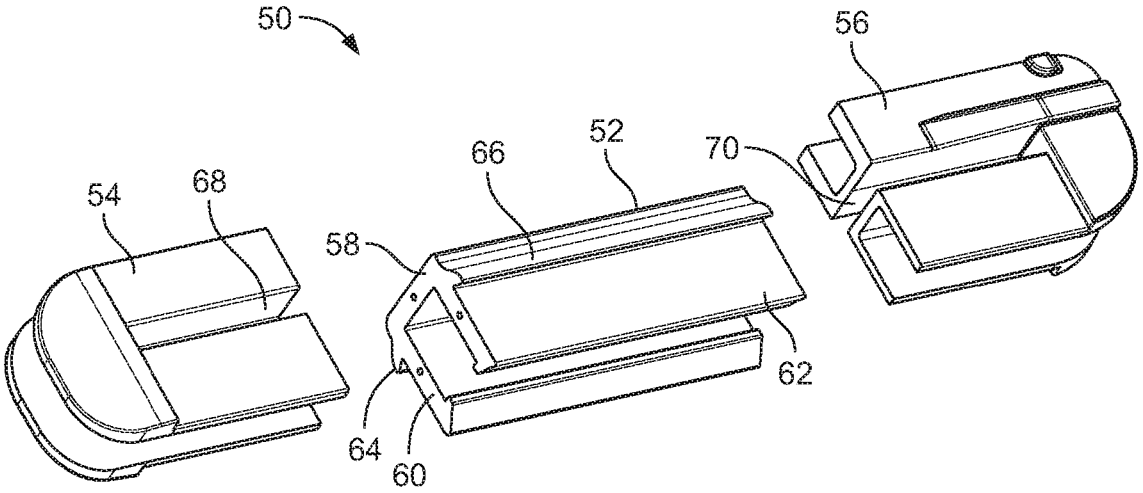
FIG. 3 is an exploded perspective view of a stator core assembly of the compressor of FIG. 1.

FIG. 3 shows an exploded perspective view of a stator core assembly 50. The stator core assembly 50 may be any one of the stator core assemblies 16, 18, 20, 22 shown in FIG. 1. The stator core assembly 50 comprises a C-shaped stator core 52, a first C-shaped bobbin portion 54 and a second C-shaped bobbin portion 56.

The stator core 52 comprises a back 58, a first arm 60 and a second arm 62. Each of the arms 60, 62 includes a respective protrusion 64, 66 on the outer surface of the stator core 52. The protrusions 64, 66 extend along the axial length of the stator core 52.

The first bobbin portion 54 includes arms that define a first slot 68. Similarly, the second bobbin portion 56 includes arms that define a second slot 70. The bobbin portions 54, 56 slide onto the stator core 52 such that, when assembled, the slots 68, 70 accommodate the back of the stator core 52. The bobbin portions 54, 56 have a generally H-shaped cross-section such that a stator winding (shown in FIG. 1) may be wound around the bobbin portions in the assembled stator core assembly, and hence around the back of the stator core 52.

FIG. 4 shows a cross-section of the assembled compressor 10 through a plane that includes the axis of rotation of the rotor assembly 12. It can be seen that the bearings 38, 40 of the rotor assembly 12 are mounted directly to and within the frame 14. The stator core assemblies 16, 20 are also shown inserted into their respective slots in the frame 14. It can be seen that on each stator core assembly 16,18,20,22 the bobbin portions 54, 56 enclose the back 58 of the stator core 52.

The diffuser assembly 28 is shown in isolation in FIGS. 10A-B and 11A-B, and comprises a first diffuser stage 100, a second diffuser stage 200 and a third diffuser stage 300. Each diffuser stage 100,200,300 is a separate component, moulded separately in separate injection moulding processes, with the diffuser stages 100,200,300 being joined together by three screws 108.

The first diffuser stage 100 is located downstream of the impeller 42, but upstream of the second diffuser stage 200. The second diffuser stage 200 is located downstream of the first diffuser stage 100, but upstream of the third diffuser stage 300. The third diffuser stage 300 is located downstream of the second diffuser stage 200. This arrangement of the diffuser stages 100,200,300 can be seen in FIGS. 4 and 10A-B. The first diffuser stage 100 may be referred to as an upstream-most diffuser stage, and the third diffuser stage 300 may be referred to as a downstream-most diffuser stage.

The first 100, second 200, and third 300 diffuser stages can be seen in isolation in FIGS. 5A-B, 6A-B and 7A-B respectively.

The first diffuser stage 100 comprises a first hub 110, a first outer wall 112, and a first plurality of blades 114. The first diffuser stage 100 has a length of 14.9085 mm in an axial direction, for example a direction parallel to a central longitudinal axis of the compressor 10. The first hub 110 is substantially cylindrical in form, and is substantially hollow, with a closed upstream end 116 and an open downstream end 118. The first hub 110 has an outer diameter corresponding substantially to an outer diameter of the impeller 42, as can be seen from FIG. 4.

Located within the hollow interior of the first hub 110 are three screw receiving spigots 120, and a primary set of anti-rotation projections 122. The three screw receiving spigots 120 are each shaped and dimensioned to receive a corresponding screw 108, and are spaced evenly about the first hub 110, for example spaced at 120° intervals. The primary set of anti-rotation projections 122 are shaped and dimensioned to be received within corresponding secondary anti-rotation recesses 216 of a second hub 202 of the second diffuser stage 104.

The first outer wall 112 is substantially cylindrical in form, and extends annularly about the first hub 110. The first plurality of blades 114 extend between the first hub 110 and the first outer wall 112, and define a first plurality of flow passageways 124 between adjacent blades 114. In the embodiment shown in FIGS. 5A and 5B, the first plurality of blades 114 comprises 11 blades. The geometry of the first plurality of blades 114 will be described further below, with reference to FIGS. 8 and 9.

The second diffuser stage 200 comprises a second hub 202, a second outer wall 204, and a second plurality of blades 206. The second diffuser stage 200 has a length of 7.69 mm in an axial direction, for example a direction parallel to a central longitudinal axis of the compressor 10. The second hub 202 is substantially cylindrical in form, and is substantially hollow, with a closed upstream end 208 and an open downstream end 210.

The second hub 202 comprises an annular wall 212 upstanding from the upstream end 208. The annular wall 212 extends about substantially the entire circumference of the second hub 202. The annular wall 212 is spaced inwardly from the circumference of the second hub 202 such that the second hub 202 comprises a shoulder 214 for engaging the first hub 110. The annular wall 212 is shaped and dimensioned to be received within the hollow interior of the first hub 110, ie within the open downstream end 118.

The annular wall 212 comprises secondary anti-rotation recesses 216 which are shaped and dimensioned to receive corresponding primary anti-rotation projections 122 of the first hub 110. The second hub 202 comprises three screw receiving through-holes 218 which are spaced evenly about the second hub 202, for example spaced at 120° intervals. The three screw receiving through-holes 218 are each shaped and dimensioned to receive a corresponding screw 108. The secondary anti-rotation recesses 216 may be used to properly align the first 100 and second 200 diffuser stages, such that the screw receiving spigots 120 are aligned with the screw receiving through-holes 218.

Figure 10A:
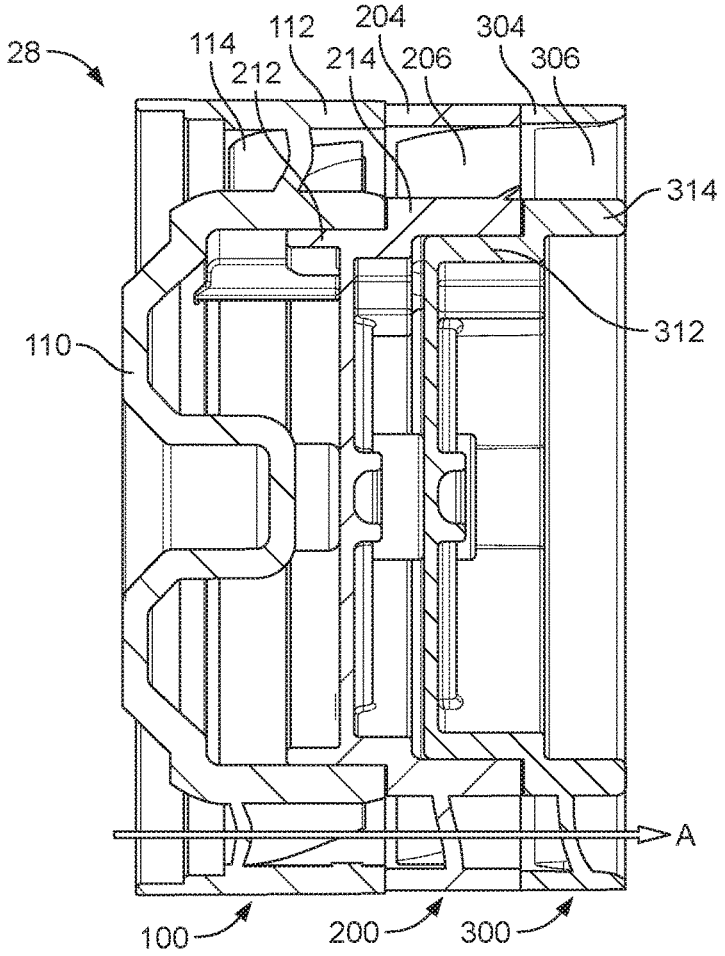
FIG. 10A is a first cross-sectional view of a diffuser assembly of the compressor of FIG. 1, taken along a central longitudinal axis of the compressor of FIG. 1.
Figure 10B:
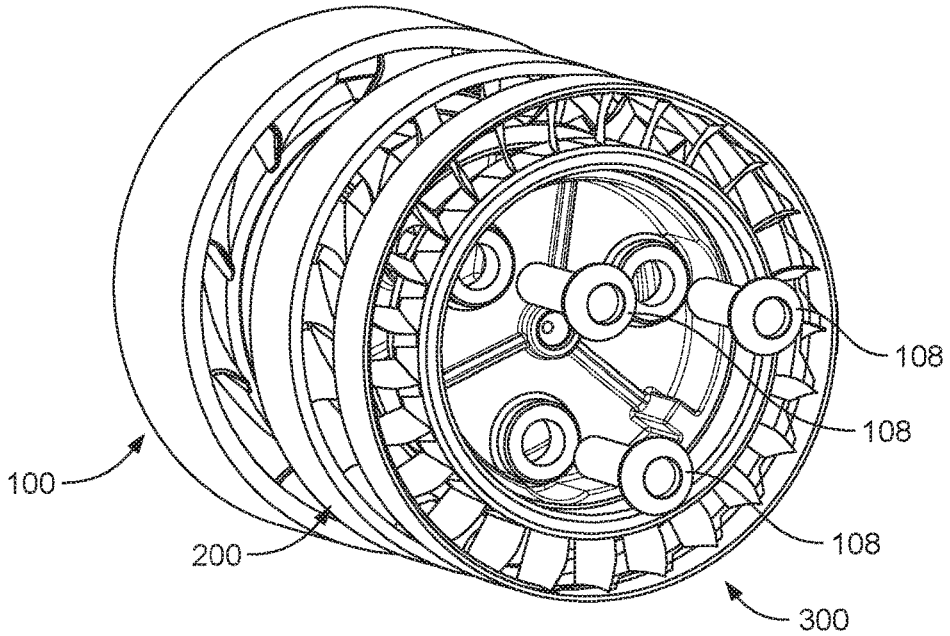
FIG. 10B is a schematic perspective view showing assembly of the diffuser assembly of the compressor of FIG. 10A.
Figure 11A:
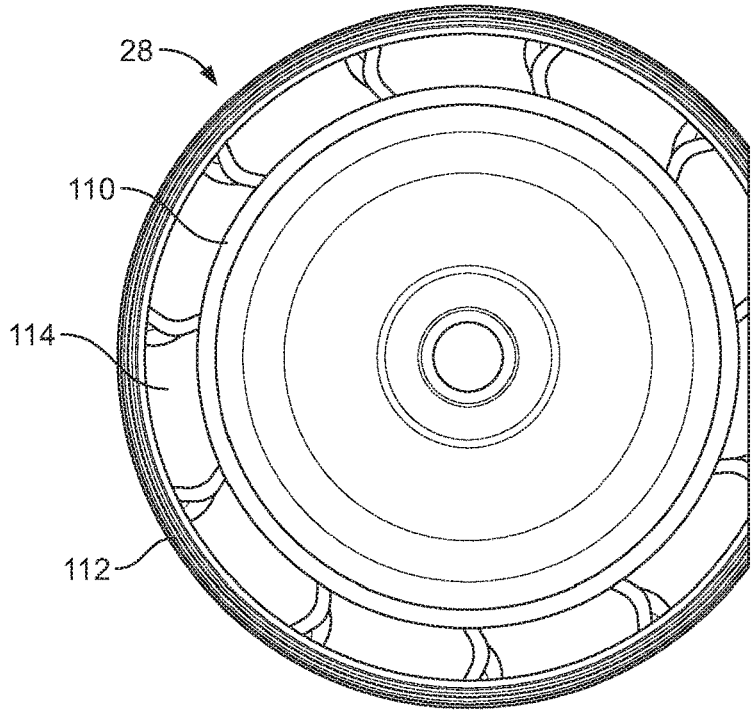
FIG. 11A is a front view of the diffuser assembly of FIG. 1 with a section removed.
Figure 11B:
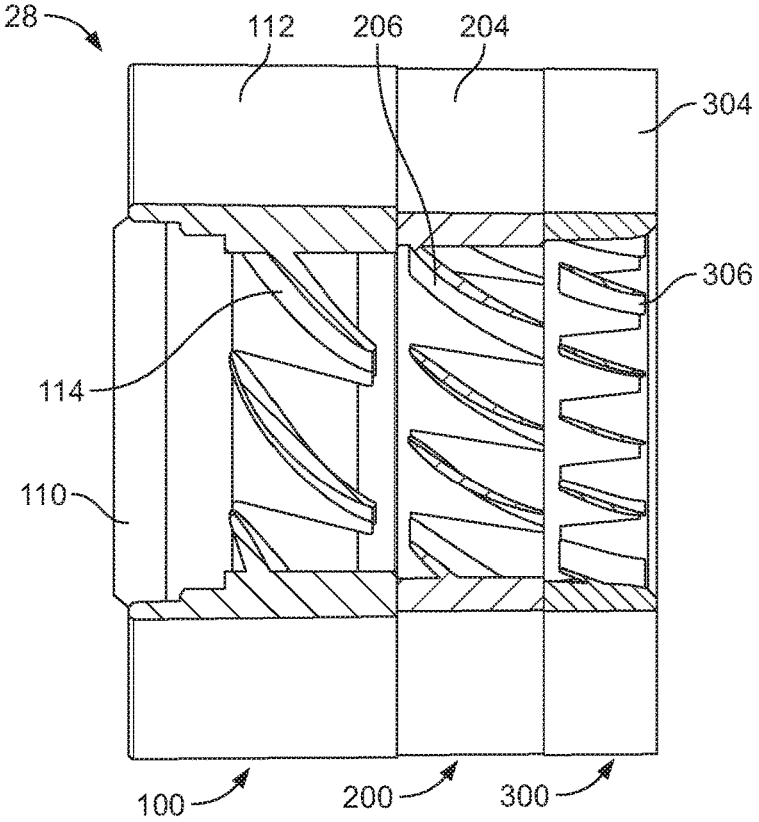
FIG. 11B is a second cross-sectional view of a diffuser assembly of the compressor of FIG. 1, corresponding to the section removed in FIG. 11A.
Figure 12A:
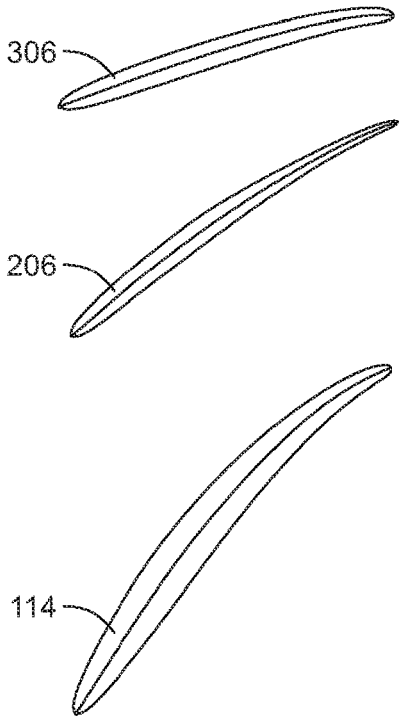
FIG. 12A is a schematic cross-sectional view through blade assemblies of first, second and third diffuser stages of the compressor of FIG. 1, taken at a hub of the corresponding diffuser stage.
Figure 12B:
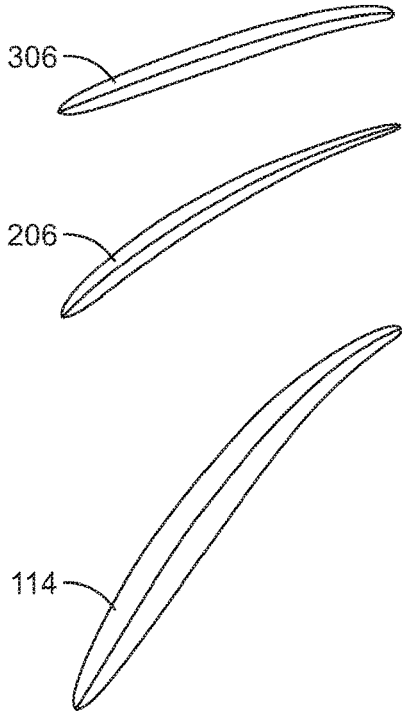
FIG. 12B is a schematic cross-sectional view through blade assemblies of first, second and third diffuser stages of the compressor of FIG. 1, taken at a mid-point along the radial distance of the blade.
Figure 12C:
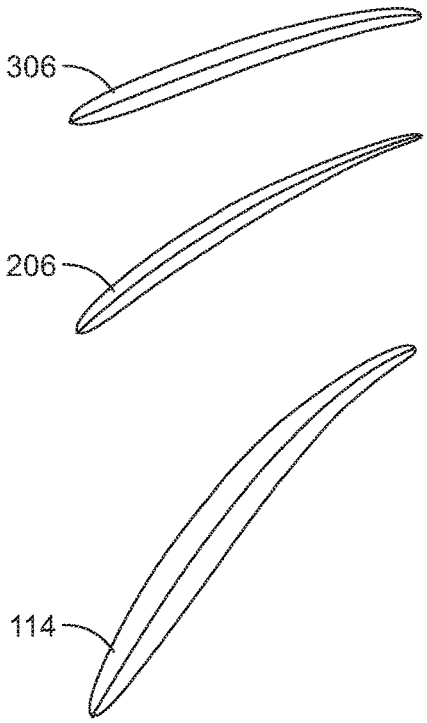
FIG. 12C is a schematic cross-sectional view through blade assemblies of first, second and third diffuser stages of the compressor of FIG. 1, taken at an outer wall of the corresponding diffuser stage.

The second hub 202 has an outer diameter corresponding substantially to an outer diameter of the first hub 110, as can be seen from FIGS. 10A-B. The second outer wall 204 has an outer diameter slightly less than the first outer wall 112, as can be seen in FIG. 10A, for example.

The screw receiving through holes 218 extend through the entirety of the second hub 202, and secondary screw receiving spigots 220 are formed about the through holes 218 in the hollow portion of the second hub 202, for example formed on the open downstream end 210 of the second hub 202. A secondary anti-rotation projection 222 is located in the hollow portion of the second hub 202, and is shaped and dimensioned to be received in a tertiary anti-rotation recess 316 of the third diffuser stage 300.

The second outer wall 204 is substantially cylindrical in form, and extends annularly about the second hub 202. The second plurality of blades 206 extend between the second hub 202 and the second outer wall 204, and define a second plurality of flow passageways 224 between adjacent blades 206. In the embodiment shown in FIGS. 6A and 6B, the second plurality of blades 206 comprises 19 blades. The geometry of the second plurality of blades 206 will be described further below, with reference to FIGS. 8 and 9.

The third diffuser stage 300 comprises a third hub 302, a third outer wall 304, and a third plurality of blades 306. The third diffuser stage 300 has a length of 5.88 mm in an axial direction, for example a direction parallel to a central longitudinal axis of the compressor 10. The third hub 302 is substantially cylindrical in form, and is substantially hollow, with a closed upstream end 308 and an open downstream end 310.

Figure 7A:
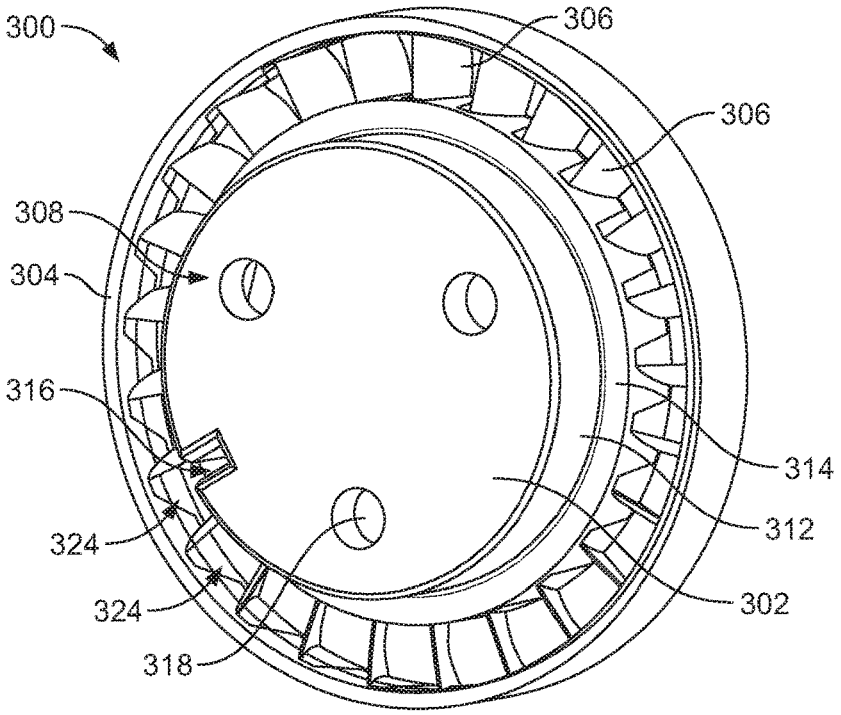
FIG. 7A is a front perspective view of a third diffuser stage of a diffuser assembly of the compressor of FIG. 1.
Figure 7B:
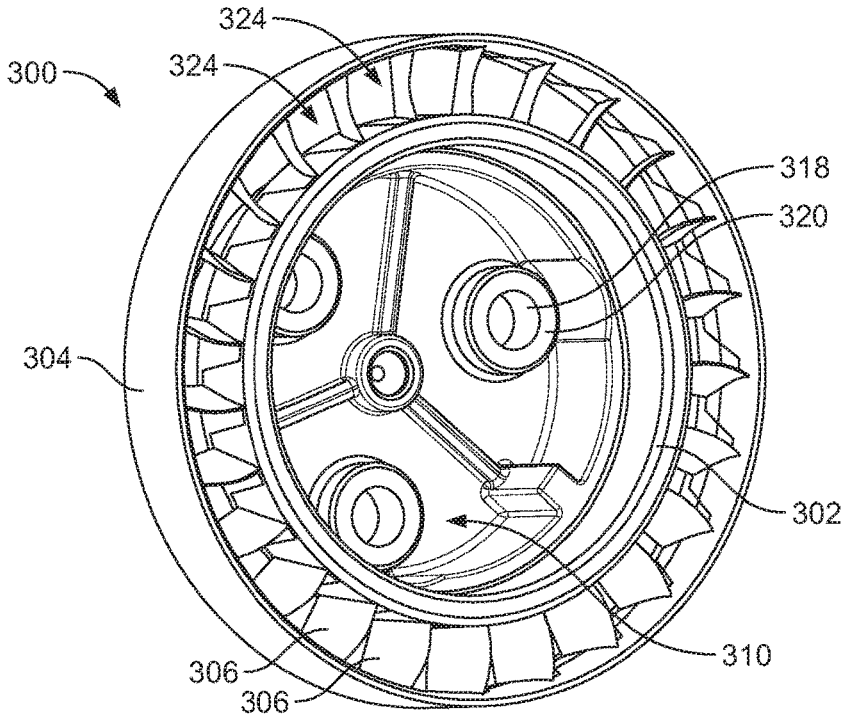
FIG. 7B is a rear perspective view of a third diffuser stage of a diffuser assembly of the compressor of FIG. 1.

The closed upstream end 308 is defined by a cylindrical projection 312, and a shoulder 314, such that the global form of the third diffuser stage corresponds substantially to that of a boater hat, as can be seen from FIG. 7A.

The cylindrical projection 312 is shaped and dimensioned to be received within the hollow interior of the second hub 202, ie within the open downstream end 210 of the second hub 202. The cylindrical projection comprises a tertiary anti-rotation recess 316 for receiving the secondary anti-rotation projection 222 of the second diffuser stage 200. The shoulder 314 is shaped and dimensioned to engage the second hub 202, and the shoulder 314 has an outer diameter corresponding substantially to an outer diameter of the second hub 202.

The third hub 302 comprises three screw receiving through-holes 318 which are spaced evenly about the third hub 302, for example spaced at 120° intervals. The three screw receiving through-holes 318 are each shaped and dimensioned to receive a corresponding screw 108. The tertiary anti-rotation recess 316 may be used to properly align the second 200 and third 300 diffuser stages, such that the screw receiving through-holes 218 of the second hub 200 are aligned with the screw receiving through-holes 318 of the third hub 300.

The third hub 302 has an outer diameter corresponding substantially to an outer diameter of the first hub 110 and an outer diameter of the second hub 203, as can be seen from FIGS. 10A-B.

The screw receiving through holes 318 extend through the entirety of the third hub 302, and tertiary screw receiving spigots 320 are formed about the through holes 318 in the hollow portion of the third hub 302, for example formed on the open downstream end 310 of the third hub 302. End faces of the tertiary screw receiving spigots 320 interface with heads of screws 108 when the diffuser assembly 28 is assembled.

The third outer wall 304 is substantially cylindrical in form, and extends annularly about the third hub 302. The third plurality of blades 306 extend between the third hub 302 and the third outer wall 304, and define a third plurality of flow passageways 324 between adjacent blades 306. In the embodiment shown in FIGS. 7A and 7B, the third plurality of blades 306 comprises 25 blades. The geometry of the third plurality of blades 306 will be described further below, with reference to FIGS. 8 and 9.

As mentioned above, each diffuser stage 100,200,300 is a separate component, for example moulded separately in separate injection moulding processes, with the diffuser stages 100,200,300 being joined together by three screws 108, as shown in FIG. 10B. Cross-sections through the diffuser assembly 28 comprising the first 100, second 200, and third 300 diffuser stages are shown in FIGS. 10A-B and 11A-B.

Once the diffuser assembly 28 is in an assembled configuration, the first 124, second 224, and third 324 pluralities of flow passageways, defined by the first 114, second 206, and third 306 pluralities of blades respectively, together form a common flow path, denoted by arrow A in FIGS. 10A-B, through the diffuser assembly 28. The first 124, second 224, and third 324 pluralities of flow passageways each diverge slightly along their length, as seen in FIG. 10A, and this may provide a reduced speed of airflow through the flow passageways 124,224,324, which may provide acoustic benefits.

The first 100, second 200 and third 300 diffuser stages are formed as separate components, and are formed from a plastic material. This enables the use of a wider range of blade geometries for the first 114, second 206, and third 306 pluralities of blades than would be possible if, for example, the diffuser assembly 28 was formed as a single component, using a single moulding process.

As can be seen from FIGS. 8, 9 and 12A-C, the first 114, second 206 and third 306 pluralities of blades 114 each have a cross-sectional shape which varies in a radial direction, with each of the blades 114, 206, 306 having a different geometry at their respective hubs 110,202,302, outer walls 112,204,304, and mid points between the hubs 110,202,302 and outer walls 112,204,304. The different cross-sectional areas can be identified in FIGS. 12A, 12B, and 12C, where FIG. 12A corresponds to cross-sectional shape at the hubs 110,202,302, FIG. 12C corresponds to cross-sectional shape at the outer walls 112,204,304 and FIG. 12B corresponds to cross-sectional at a mid-point between respective hubs 110, 202,302 and outer walls 112,204,304.

As can further be seen from FIGS. 8 and 9, other geometrical properties and parameters of the blades 114, 206,306 vary both between sets of blades, and in a radial direction along each blade of a set of blades 114,206,306 between respective hubs 110,202,302 and outer walls 112, 204,304.

The first plurality of blades 114 have a stagger angle of 57.4° at the first hub 110, a stagger angle of 54.0° at a mid-point, and a stagger angle of 53.7° at the first outer wall 112. Stagger angle here is measured as an angle between a line parallel to a central longitudinal axis of the compressor 10 and a chord of the diffuser blade, as shown by γ in FIG. 13.

The first plurality of blades 114 have a blade inlet angle of 64.3° at the first hub 110, a blade inlet angle of 64.3° at a mid-point, and a blade inlet angle of 64.2° at the first outer wall 112. Blade inlet angle is here measured as an angle between a line parallel to a central longitudinal axis of the compressor 10 and a line tangential to a camber curve of a diffuser blade at the leading edge of the diffuser blade, as shown by β1 in FIG. 13.

Figure 13:
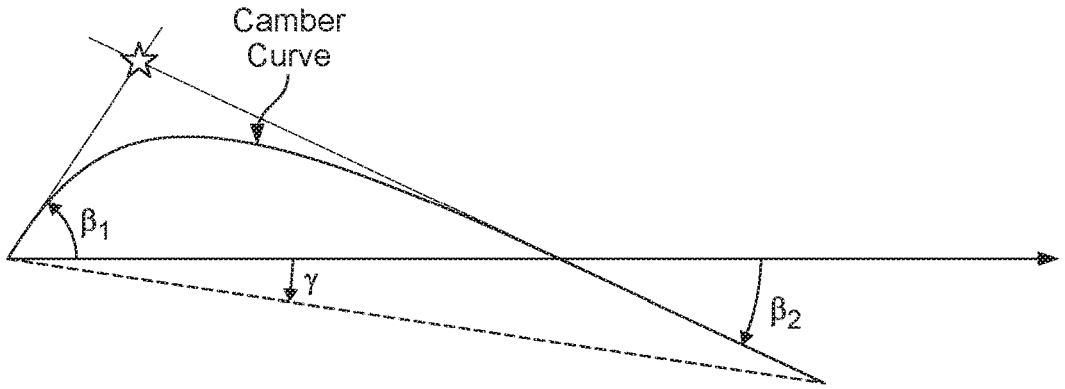
FIG. 13 is a schematic diagram indicating blade parameters for diffuser stages of the compressor of FIG. 1.

The first plurality of blades 114 have a blade outlet angle of 26.2° at the first hub 110, a blade outlet angle of 26.5° at a mid-point, and a blade outlet angle of 26.2° at the first outer wall 112. Blade outlet angle is here measured as an angle between a line parallel to a central longitudinal axis of the compressor and a line tangential to a camber curve of a diffuser blade at the trailing edge of the diffuser blade, as shown by β2 in FIG. 13. As shown in FIG. 13, the blade outlet angle β2 is a negative blade outlet angle, and the tangential line is inclined in an opposite direction to the tangential line which encloses the angle β1. It will be appreciated that, although not shown in FIG. 13, for a positive blade outlet angle β2, the tangential line at the trailing edge of the diffuser blade is inclined in the same direction as the tangential line at the leading edge of the diffuser blade.

The first plurality of blades 114 have a maximum blade thickness of 0.0012 m, with the maximum thickness located at 41.74% of chord length from the leading edge.

The first plurality of blades 114 have a chord length of 0.0128 m at the first hub 110, a chord length of 0.01270 m at a mid-point, and a chord length of 0.01261 m at the first outer wall 112.

The first plurality of blades 114 have an axial chord length of 0.007455 m at the first hub 110, an axial chord length of 0.007461 m at a mid-point, and an axial chord length of 0.007466 m at the first outer wall 112.

The first plurality of blades 114 have a solidity of 1.3 at the first hub 110, a solidity of 1.2 at a mid-point, and a solidity of 1.08 at the first outer wall 112.

The first plurality of blades 114 have an axial solidity of 0.76 at the first hub 110, an axial solidity of 0.6922 at a mid-point, and an axial solidity of 0.64 at the first outer wall 112.

The first plurality of blades 114 have a sweep of −7° at the leading edge, and a sweep of 0° at the trailing edge. The first plurality of blades 114 have a lean of −8° at the first hub 110, and a lean of 8° at the first outer wall 112.

The second plurality of blades 206 have a stagger angle of 39.8° at the second hub 202, a stagger angle of 33.4° at a mid-point, and a stagger angle of 34.3° at the second outer wall 204.

The second plurality of blades 206 have a blade inlet angle of 48.5° at the second hub 202, a blade inlet angle of 48.5° at a mid-point, and a blade inlet angle of 47.4° at the second outer wall 204.

The second plurality of blades 206 have a blade outlet angle of 25.2° at the second hub 202, a blade outlet angle of 18.6° at a mid-point, and a blade outlet angle of 20.9° at the second outer wall 204.

The second plurality of blades 206 have a maximum blade thickness of 0.00063 m, with the maximum thickness located at 34.14% of chord length from the leading edge.

The second plurality of blades 206 have a chord length of 0.0091 m at the second hub 202, a chord length of 0.0084 m at a mid-point, and a chord length of 0.0085 m at the second outer wall 204.

The second plurality of blades 206 have an axial chord length of 0.00698 m at the second hub 202, an axial chord length of 0.00698 m at a mid-point, and an axial chord length of 0.00698 m at the second outer wall 204.

The second plurality of blades 206 have a solidity of 1.6 at the second hub 202, a solidity of 1.3 at a mid-point, and a solidity of 1.2 at the second outer wall 204.

The second plurality of blades 206 have an axial solidity of 1.2 at the second hub 202, an axial solidity of 1.1 at a mid-point, and an axial solidity of 1.0 at the second outer wall 204.

The second plurality of blades 206 have a sweep of 0° at the leading edge, and a sweep of 0° at the trailing edge. The second plurality of blades 206 have a lean of 1.8° at the second hub 202, and a lean of 0.1° at the second outer wall 204.

The third plurality of blades 306 have a stagger angle of 19° at the third hub 302, a stagger angle of 21.4° at a mid-point, and a stagger angle of 19.7° at the third outer wall 304.

The third plurality of blades 306 have a blade inlet angle of 24.9° at the third hub 302, a blade inlet angle of 27.2° at a mid-point, and a blade inlet angle of 26.6° at the third outer wall 304.

The third plurality of blades 306 have a blade outlet angle of −5.9° at the third hub 302, a blade outlet angle of 0.4° at a mid-point, and a blade outlet angle of −5.3° at the third outer wall 304.

The third plurality of blades 306 have a maximum blade thickness of 0.00035 m, with the maximum thickness located at 39.00% of chord length from the leading edge.

The third plurality of blades 306 have a chord length of 0.0037 m at the third hub 302, a chord length of 0.0038 m at a mid-point, and a chord length of 0.0037 m at the third outer wall 304.

The third plurality of blades 306 have an axial chord length of 0.0035 m at the third hub 302, an axial chord length of 0.0035 m at a mid-point, and an axial chord length of 0.0035 m at the third outer wall 304.

The third plurality of blades 306 have a solidity of 1.1 at the third hub 302, a solidity of 1.0 at a mid-point, and a solidity of 0.9 at the third outer wall 304.

The third plurality of blades 306 have an axial solidity of 1.1 at the third hub 302, an axial solidity of 0.97 at a mid-point, and an axial solidity of 0.88 at the third outer wall 304.

The third plurality of blades 306 have a sweep of 0° at the leading edge, and a sweep of 0° at the trailing edge. The third plurality of blades 306 have a lean of −0.2° at the third hub 302, and a lean of 0.5° at the third outer wall 304.

The inventors of the present application have found that utilising a diffuser assembly 28 comprising first 100, second 200, and third 300 diffuser stages having the blade geometries discussed above may be beneficial relative to use of only a first diffuser stage 100 having the blade geometries discussed above.

Figure 14:
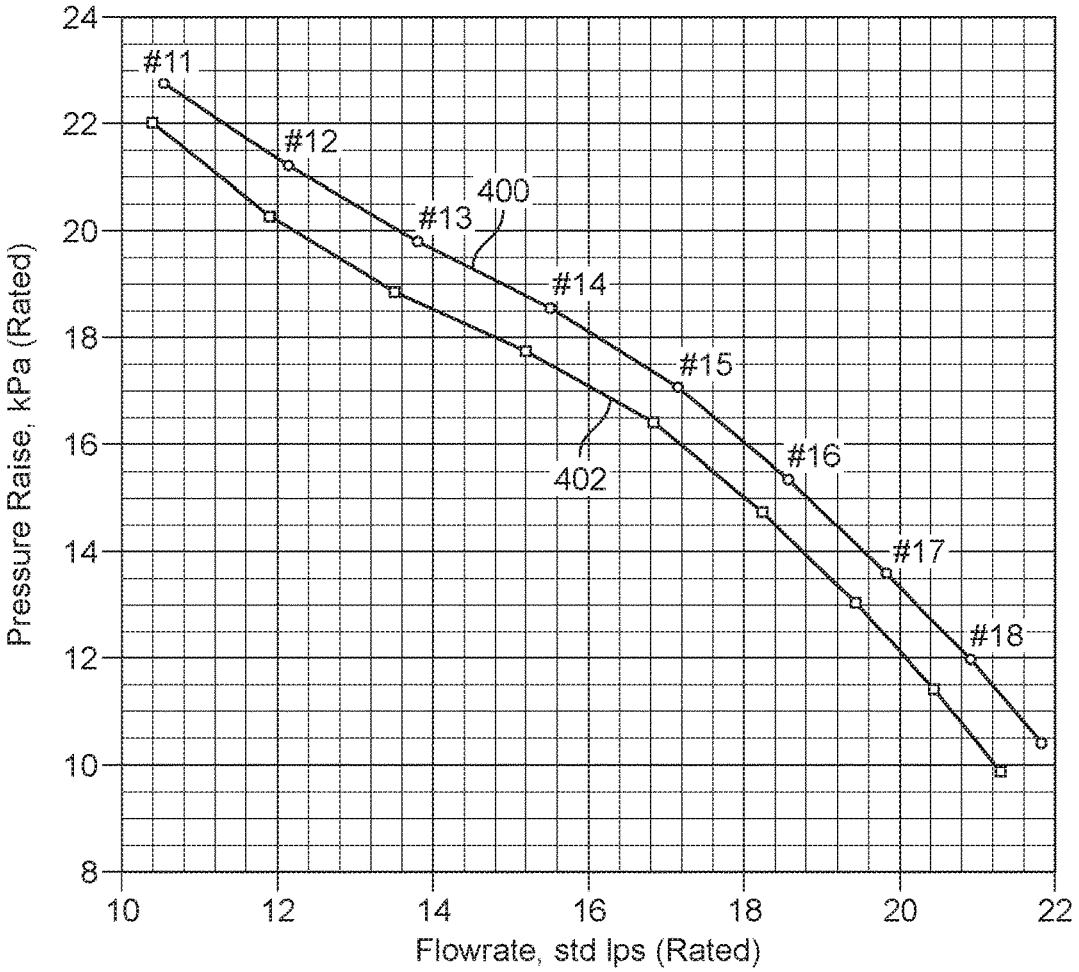
FIG. 14 is a plot of pressure rise against flow rate for the compressor of FIG. 1.
Figure 15:
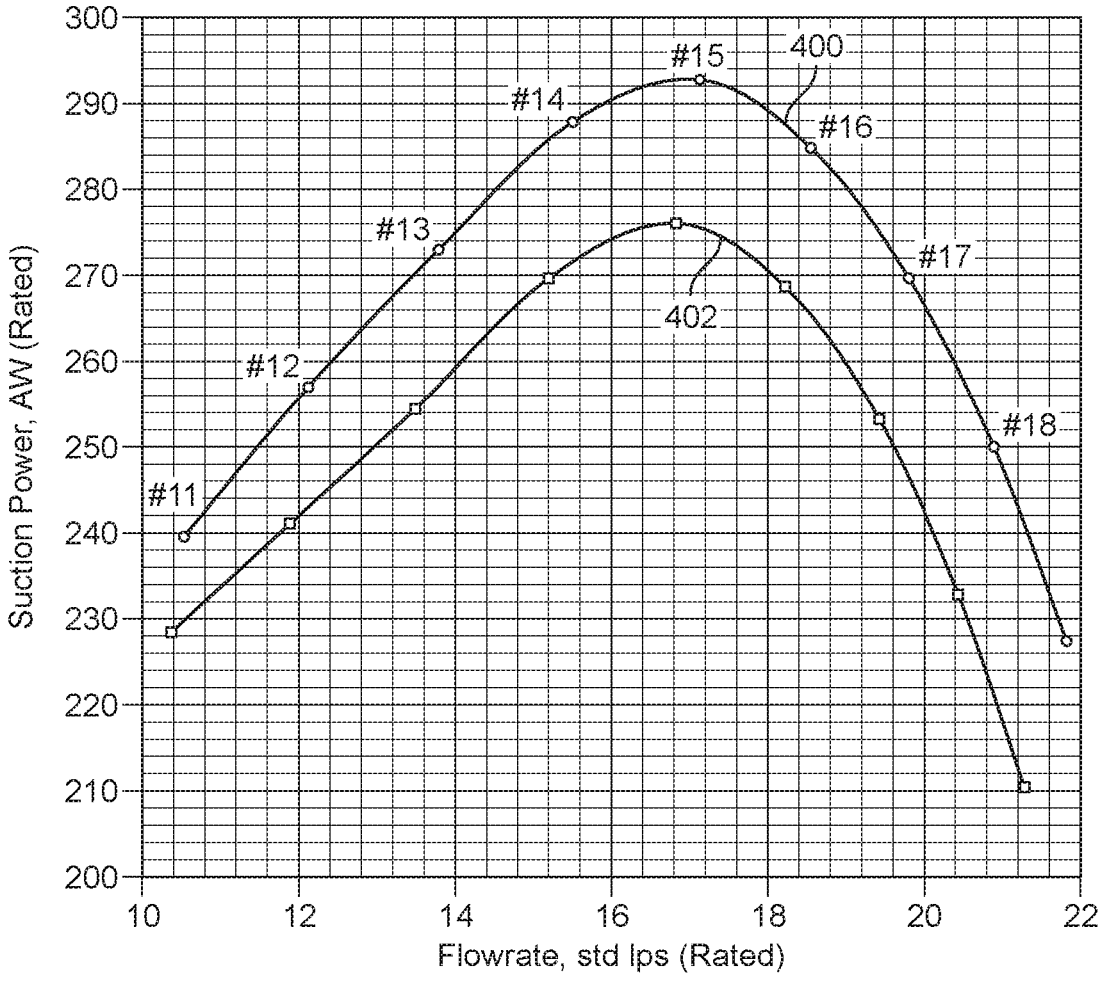
FIG. 15 is a plot of suction power against flow rate for the compressor of FIG. 1.

In particular, and as can be seen from FIGS. 14 and 15, a compressor utilising diffuser assembly 28, indicated by line 400, as opposed to a compressor utilising solely diffuser stage 100, indicated by line 402, can achieve both a greater pressure raise and an increase in suction power (airwatts) for a given flow rate. The additional diffuser stages 200,300 which provide this improved performance are enabled by forming the diffuser stages 100,200,300 as separate components, and attaching the diffuser stages 100,200,300 with the screws 108.

Figure 16:
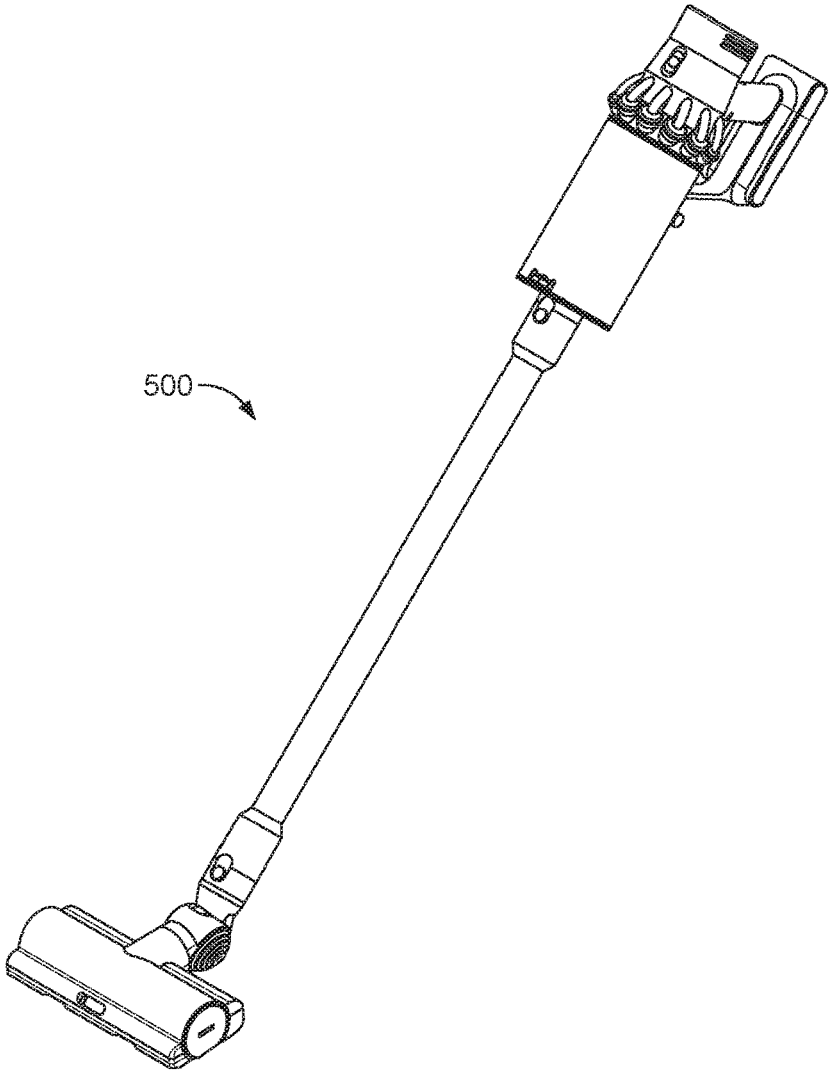
FIG. 16 is a perspective view of a vacuum cleaner comprising the compressor of FIG. 1.

A vacuum cleaner 500 comprising a compressor 10 according to an aspect of the present invention is shown in FIG. 16. The vacuum cleaner 500 benefits from the increase in suction power (air watts) discussed above.

Figure 17:
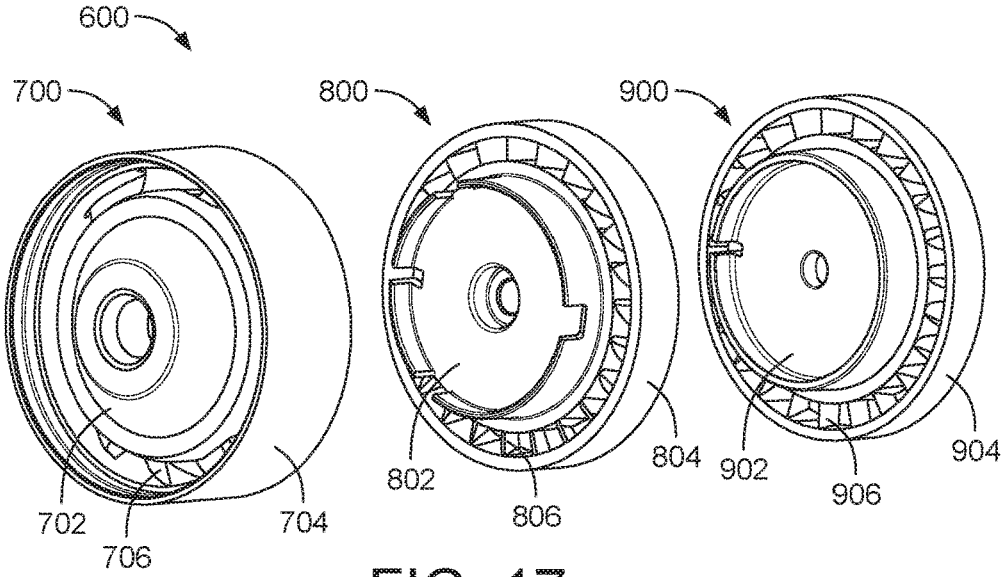
FIG. 17 is an exploded perspective view of a diffuser assembly for use with the compressor of FIG. 1.

A second embodiment of a diffuser assembly 600 for use with the compressor 10 is shown in FIG. 17, and comprises first 700, second 800, and third 900 diffuser stages.

The general structure of the first 700, second 800 and third 900 diffuser stages of the second diffuser assembly 600 is substantially the same as the structure of the corresponding first 100, second 200 and third 300 diffuser stages of the first diffuser assembly 28, and hence only the differences will be described for the sake of brevity.

Each of the first 700, second 800, and third 900 diffuser stages comprises a hub 702,802,902, an outer wall 704,804, 904, and a plurality of diffuser blades 706,806,906 extending between the hub 702,802,902 and the outer wall 704,804, 904. Each of the first 700, second 800, and third 900 diffuser stages comprises a single corresponding screw receiving formation 708,808,908 for receiving a screw 108. The screw receiving formations 708,808,908 are located centrally on corresponding hubs of the first 700, second 800, and third 900 diffuser stages.

The first 700, second 800 and third 900 diffuser stages of the second diffuser assembly 600 also differ from the first 100, second 200 and third 300 diffuser stages of the first diffuser assembly 28 in their diffuser blade geometry. The blade geometries of the first 700, second 800 and third 900 diffuser stages are described below, with reference to FIGS. 18 and 19.

The first plurality of blades 706 have a stagger angle of 60.2° at the first hub 702, and a stagger angle of 58.2° at the first outer wall 704. The first plurality of blades 706 have a blade inlet angle of 70.8° at the first hub 702, and a blade inlet angle of 72.6° at the first outer wall 704. The first plurality of blades 706 have a blade outlet angle of 46.7° at the first hub 702, and a blade outlet angle of 39.3° at the first outer wall 704.

The first plurality of blades 706 have a maximum blade thickness of 0.000876 m at the first hub 702, with the maximum thickness located at 35.0% of chord length from the leading edge. The first plurality of blades 706 have a maximum blade thickness of 0.000875 m at the first outer wall 704, with the maximum thickness located at 33.7% of chord length from the leading edge.

The first plurality of blades 706 have a chord length of 0.0196 m at the first hub 702, and a chord length of 0.0171 m at the first outer wall 704. The first plurality of blades 706 have an axial chord length of 0.0097 m at the first hub 702, and an axial chord length of 0.0090 m at the first outer wall 708. The first plurality of blades 706 have a solidity of 1.8 at the first hub 702, and a solidity of 1.3 at the first outer wall 704. The first plurality of blades 706 have an axial solidity of 0.9 at the first hub 702, and an axial solidity of 0.7 at the first outer wall 704.

The first plurality of blades 114 have a sweep of 25°. The first plurality of blades 114 have a lean of 1.6° at the first hub 702, and a lean of 1.6° at the first outer wall 704.

The second plurality of blades 806 have a stagger angle of 33.0° at the second hub 802, and a stagger angle of 27.2° at the second outer wall 804. The second plurality of blades 806 have a blade inlet angle of 54.9° at the second hub 802, and a blade inlet angle of 49.9° at the second outer wall 804. The second plurality of blades 806 have a blade outlet angle of 14.4° at the second hub 802, and a blade outlet angle of 8.4° at the second outer wall 804.

The second plurality of blades 806 have a maximum blade thickness of 0.000642 m at the second hub 802, with the maximum thickness located at 37.6% of chord length from the leading edge. The second plurality of blades 806 have a maximum blade thickness of 0.000640 m at the second outer wall 804, with the maximum thickness located at 36.3% of chord length from the leading edge.

The second plurality of blades 806 have a chord length of 0.0083 m at the second hub 802, and a chord length of 0.0078 m at the second outer wall 804. The second plurality of blades 806 have an axial chord length of 0.0070 m at the second hub 802, and an axial chord length of 0.0070 m at the second outer wall 804. The second plurality of blades 806 have a solidity of 1.6 at the second hub 802, and a solidity of 1.3 at the second outer wall 804. The second plurality of blades 806 have an axial solidity of 1.4 at the second hub 802, and an axial solidity of 1.1 at the second outer wall 804.

The second plurality of blades 806 have a sweep of 0°. The second plurality of blades 806 have a lean of −0.1° at the second hub 802, and a lean of −0.1° at the second outer wall 804.

The third plurality of blades 906 have a stagger angle of 17.0° at the third hub 902, and a stagger angle of 17.0° at the third outer wall 904. The third plurality of blades 906 have a blade inlet angle of 24.6° at the third hub 902, and a blade inlet angle of 24.3° at the third outer wall 904. The third plurality of blades 906 have a blade outlet angle of 6.5° at the third hub 902, and a blade outlet angle of 6.8° at the third outer wall 904.

The third plurality of blades 906 have a maximum blade thickness of 0.000642 m at the third hub 902, with the maximum thickness located at 37.6% of chord length from the leading edge. The third plurality of blades 906 have a maximum blade thickness of 0.000638 m at the third outer wall 904, with the maximum thickness located at 36.3% of chord length from the leading edge.

The third plurality of blades 906 have a chord length of 0.0063 m at the third hub 902, and a chord length of 0.0063 m at the third outer wall 904. The third plurality of blades 906 have an axial chord length of 0.0060 m at the third hub 902, and an axial chord length of 0.0060 m at the third outer wall 904. The third plurality of blades 906 have a solidity of 1.2 at the third hub 902, and a solidity of 1.0 at the third outer wall 904. The third plurality of blades 906 have an axial solidity of 1.2 at the third hub 902, and an axial solidity of 1.0 at the third outer wall 904.

The third plurality of blades 906 have a sweep of 0°. The third plurality of blades 906 have a lean of −0.1° at the third hub 902, and a lean of −0.1° at the third outer wall 904.

The first diffuser stage 700 comprises 11 blades 706, and has an axial length of 13 mm. The second diffuser stage 800 comprises 23 blades 806, and has an axial length of 8 mm. The third diffuser stage 900 comprises 23 blades 906, and has an axial length of 7 mm.

As indicated above, forming the first 700, second 800, and third 900 diffuser stages as separate components enables the use of a wider range of blade geometries, which may provide performance benefits, for example in terms pressure recovery and acoustics.

The invention claimed is:

1. A compressor comprising a rotor assembly having an impeller for generating an airflow through the compressor, a stator core assembly for causing rotation of the impeller, and a diffuser assembly for acting on the airflow generated by the impeller, wherein the diffuser assembly comprises a first diffuser stage and a second diffuser stage, the first and second diffuser stages comprising separate components connected to one another by a fastener;

wherein the first diffuser stage comprises a first hub, a first outer wall, and a first plurality of diffuser blades extending between the first hub and the first outer wall, and the second diffuser stage comprises a second hub, a second outer wall, and a second plurality of diffuser blades extending between the second hub and the second outer wall; and wherein the fastener extends between the first and second hubs at a location remote from an outer diameter of the first and the second hubs, such that the fastener is removed from the common flow path.

2. The compressor of claim 1, wherein the first and second diffuser stages are formed by separate moulding processes.

3. The compressor of claim 1, wherein the first and second hubs and the first and second outer walls comprise a cylindrical global form.

4. The compressor of claim 1, wherein at least one of the first or second hub is hollow, and the other of the second or first hub, comprises a locating projection which extends into the hollow interior of the first or second hub.

5. The compressor of claim 1, wherein the second diffuser stage comprises an outer diameter smaller than an outer diameter of the first diffuser stage.

6. The compressor of claim 1, wherein the first diffuser stage comprises a first anti-rotation projection and/or recess for engaging a corresponding second anti-rotation recess and/or projection of the second diffuser stage.

7. The compressor of claim 1, wherein the second diffuser stage comprises a greater number of diffuser blades than the first diffuser stage.

8. The compressor of claim 1, wherein diffuser blade inlet angles vary between the first and second diffuser stages.

9. The compressor of claim 1, wherein diffuser blade outlet angles vary between the first and second diffuser stages.

10. The compressor of claim 1, wherein the first diffuser stage comprises a diffuser blade outlet angle which is smaller than a diffuser blade inlet angle of the second diffuser stage.

11. The compressor of claim 1, wherein the second diffuser stage comprises a stagger angle which is smaller than a stagger angle of the first diffuser stage.

12. The compressor of claim 1, wherein a maximum diffuser blade thickness of the first diffuser stage is greater than a maximum diffuser blade thickness of the second diffuser stage.

13. The compressor of claim 1, wherein the second diffuser stage comprises a diffuser blade chord length smaller than a diffuser blade chord length of the first diffuser stage.

14. The compressor of claim 1, wherein the second diffuser stage comprises a greater diffuser blade solidity than the first diffuser stage.

15. The compressor of claim 1, wherein the impeller comprises a mixed flow impeller.

16. The compressor of claim 1, wherein the diffuser assembly comprises a third diffuser stage, the second diffuser stage is located downstream of the first diffuser stage, and the third diffuser stage is located downstream of the second diffuser stage.

17. A vacuum cleaner comprising the compressor of claim 1.

18. A diffuser assembly for a compressor, the diffuser assembly comprising a first diffuser stage and a second diffuser stage, wherein the first and second diffuser stages comprise separate components connected to one another by a fastener;

wherein the first diffuser stage comprises a first hub, a first outer wall, and a first plurality of diffuser blades extending between the first hub and the first outer wall, and the second diffuser stage comprises a second hub, a second outer wall, and a second plurality of diffuser blades extending between the second hub and the second outer wall; and wherein the fastener extends between the first and second hubs at a location remote from an outer diameter of the first and the second hubs, such that the fastener is removed from the common flow path.

* * * * *